US009050613B2

(12) United States Patent
Bishop

(10) Patent No.: US 9,050,613 B2
(45) Date of Patent: Jun. 9, 2015

(54) SHOWER SOAP DISPENSER FOR LIQUID SOAPS

(71) Applicant: Robert A Bishop, Enola, AR (US)

(72) Inventor: Robert A Bishop, Enola, AR (US)

( * ) Notice: Subject to any disclaimer, the term of this patent is extended or adjusted under 35 U.S.C. 154(b) by 130 days.

(21) Appl. No.: 13/688,024

(22) Filed: Nov. 28, 2012

(65) Prior Publication Data

US 2013/0186971 A1 Jul. 25, 2013

Related U.S. Application Data

(63) Continuation-in-part of application No. 12/657,992, filed on Feb. 1, 2010, now abandoned.

(51) Int. Cl.

| | |
|---|---|
| ***B05B 7/04*** | (2006.01) |
| ***B05B 7/30*** | (2006.01) |
| ***E03C 1/046*** | (2006.01) |
| ***B05B 7/24*** | (2006.01) |
| *B05B 1/18* | (2006.01) |

(52) U.S. Cl.
CPC ... *B05B 7/30* (2013.01); *B05B 1/18* (2013.01); *B05B 7/0425* (2013.01); *B05B 7/2443* (2013.01); *E03C 1/046* (2013.01)

(58) Field of Classification Search
CPC ..... B05B 7/04; B05B 7/0815; B05B 7/30; B05B 7/26; B05B 7/2443; B29B 7/7452; E03C 1/046; B01F 5/0413
USPC ..... 239/310, 311, 318, 335, 581.1, 315; 137/889, 893, 894, 625.41, 113, 316
See application file for complete search history.

(56) References Cited

U.S. PATENT DOCUMENTS

| | | | | |
|---|---|---|---|---|
| 2,462,752 | A * | 2/1949 | Kotches | 239/312 |
| 2,621,012 | A * | 12/1952 | Graham | 251/207 |
| 2,782,726 | A * | 2/1957 | Perrin | 417/186 |
| 2,965,313 | A * | 12/1960 | Jay | 239/581.1 |
| 4,714,092 | A * | 12/1987 | Sanders | 137/894 |
| 7,118,049 | B2 * | 10/2006 | Dodd | 239/318 |
| 7,503,345 | B2 * | 3/2009 | Paterson et al. | 137/625.47 |

* cited by examiner

*Primary Examiner* — Dinh Q Nguyen
*Assistant Examiner* — Chee-Chong Lee

(57) ABSTRACT

An improved shower soap dispenser for use with liquid soap, gels and body washes. It consists of a soap storage reservoir, main body containing control valves that intersects and connects directly to a conventional shower pipe and shower head. It mixes an adjustable amount of liquid soap with air into the flowing water. Its improved main valve, through incorporation of a truncated cone, provides greater vacuum and water flow to make it compatible with a wider range of water pressure and soap density and viscosity. The improved main valve also provides the capability for the user to clean out water passages of the dispenser without disassembly or removing any parts.

8 Claims, 5 Drawing Sheets

SHOWER SOAP DISPENSER FOR LIQUID SOAPS

This is a continuation in part of application Ser. No. 12/657,992 filed Feb. 2, 2010.

The present application relates to U.S. Pat. No. 5,356,076 to Bishop which is fully incorporated herein by reference, including all figures and referenced elements of that invention.

BACKGROUND

The present invention relates to soap dispenser apparatuses for attachment to conventional shower pipe and shower heads used in showers and in particular to valves used in liquid soap dispenser apparatuses. One such invention is U.S. Pat. No. 5,356,076. The liquid soaps range from thin liquids to thick gels with a wide range of viscosity causing problems for devices in which the soap is to be mixed into a water flow. Devices utilizing valves to mix the soap into a water stream that must be capable of working with all of these types of soaps.

Any debris present in water flowing through a device may become lodged in any restricted passages of the device. If the debris is large enough to become trapped in a shower device it could restrict the flow of water through the device. Devices which provide a valve clean-out capability provide unique advantages over devices lacking such a feature.

SUMMARY

The present invention is directed to a improved main valve element for a soap dispenser having an essentially cylindrical form, and mounted so that it can rotate within the main valve cavity. An embodiment of the main valve element comprises a metering passage and a straight through passage to control the water flow and the mixing of water and soap.

An embodiment of the metering passage comprises an inlet section, a mixing intersection and an outlet section. The metering passage inlet section has a cross-sectional area smaller than the cross-sectional area of the metering passage outlet section. The metering passage mixing intersection separates the metering passage inlet and outlet section. The metering passage extends approximately diametrically through the main valve element and is positioned so that when the main valve element is rotated to a soap position the metering passage inlet section is aligned with a dispenser body inlet passage and the metering passage outlet section is aligned with a dispenser body outlet passage. When the main valve element is rotated to a cleaning position the metering passage inlet section is aligned with the dispenser body outlet passage and the metering passage outlet section is aligned with the dispenser body inlet passage.

The straight-through passage consists of an inlet and an outlet, and extends through the main valve element at approximately its diameter. It communicates with the metering passage at the mixing intersection. The metering passage outlet section extends into the straight-through passage approximately one-half of the diameter of the straight-through passage in the shape of a truncated cone with the base of the cone at the circumference of the straight-through passage and the top of the cone opening at the intersection. A soap supply passage is positioned so that when the main valve element is rotated to the soap position the straight-through passage communicates with the soap supply passage, and when the main valve element is rotated to a rinse position the straight-through passage communicates with the body inlet passage and the body outlet passage. When the main valve element is rotated to a off-trickle position the straight-through passage inlet section is aligned so that it communicates with the dispenser body inlet at a straight-through passage inlet notch, and the straight-through passage outlet section is aligned so that it communicates with the dispenser body outlet section at a straight-through passage outlet notch.

BRIEF DESCRIPTION OF THE DRAWINGS

These and other features, aspects, and advantages of the present invention will become better understood with regard to the following description, appended claims, and accompanying drawings where:

DESCRIPTION OF PREFERRED EMBODIMENTS

Various embodiments of the invention are directed to an improved shower soap dispenser for liquid soaps. The improved main valve element of the shower soap dispenser incorporates features to work in an extremely wide variety of water pressures while still delivering an exceptional and desirable flow of water.

Figure 1A:
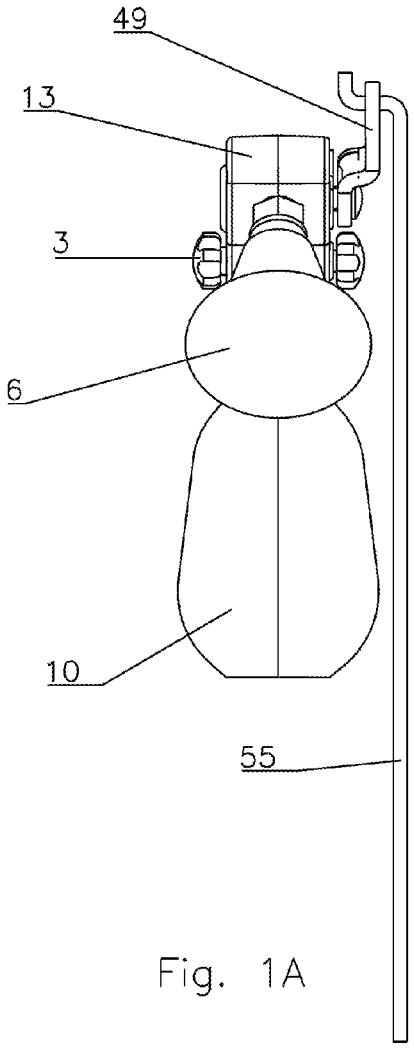
FIG. 1A shows a front view of an embodiment of the shower soap dispenser.
Figure 1B:
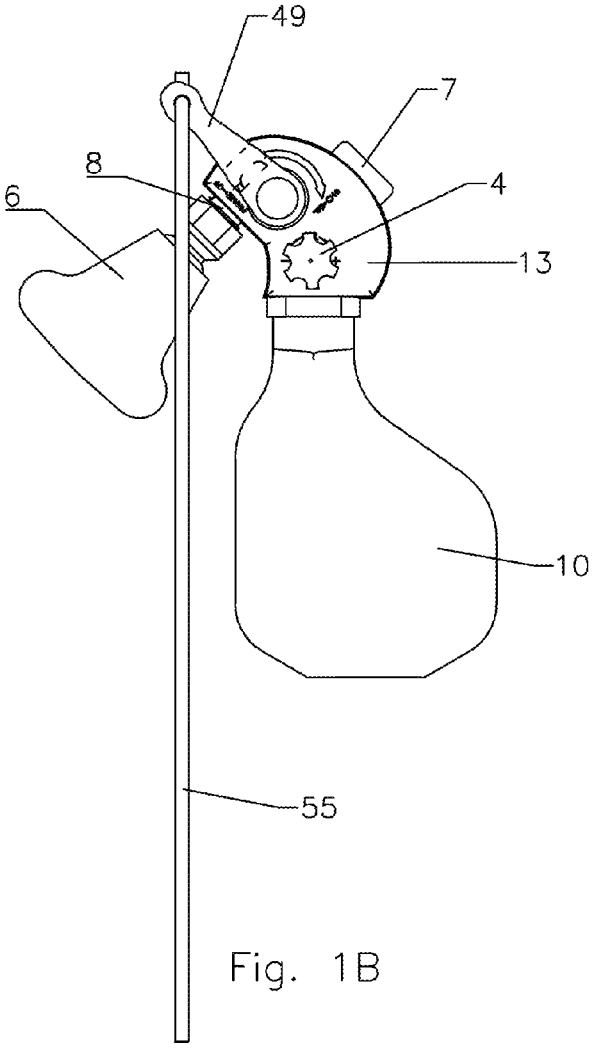
FIG. 1B shows a right side view of an embodiment of the shower soap dispenser with extension handle.

FIGS. 1A and 1B show an embodiment of the invention. In this embodiment a water supply is connected to a water supply inlet 7 creating a water flows through a dispenser body 13 to a water supply outlet 8 to which is connected a shower head 6. Soap is contained in a reservoir 10 and introduced into the water flow inside the dispenser body 13. A soap valve 3 controls the amount of soap which is mixed into the water flow to suit individual user preferences and to accommodate different viscosities of liquid soap. An air valve 4 controls the amount of air which is introduced into the soap before it is mixed with the water flow. A selector handle 49 controls the mode of operation of the dispenser. This embodiment includes an extension lever 55 which communicates with the selector handle 49 to enable easier operation of the dispenser by disabled individuals.

Figures 2A, 2B, 2C, 2D:
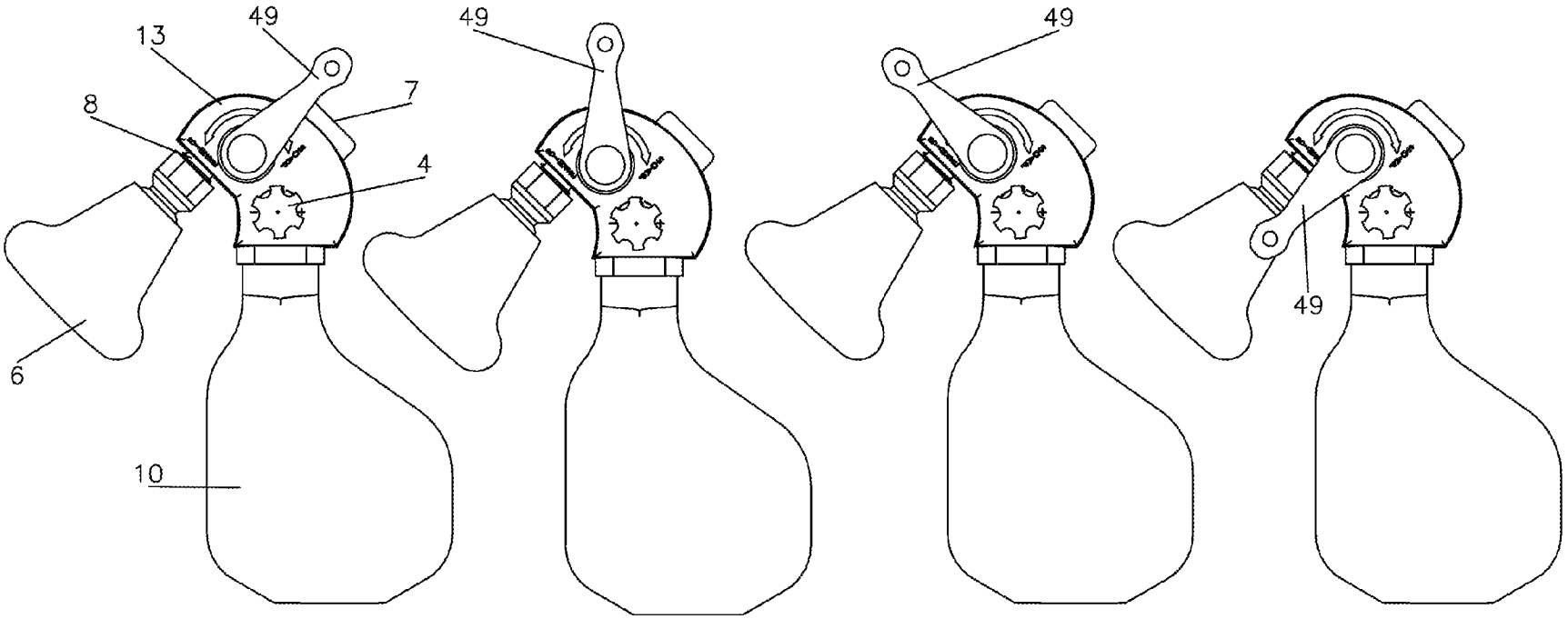
FIG. 2A shows a right side view of an embodiment of the shower soap dispenser with selector handle in the soap position.
FIG. 2B shows a right side view of an embodiment of the shower soap dispenser with selector handle in the off-trickle position.
FIG. 2C shows a right side view of an embodiment of the shower soap dispenser with selector handle in the rinse position.
FIG. 2D shows a right side view of an embodiment of the shower soap dispenser with selector handle in the clean-out position.

An embodiment of the dispenser has four modes of operation which are controlled by the selector handle 49 and shown in FIGS. 2A, 2B, 2C, and 2D. The four modes of operation are a "soap" mode, an "off-trickle" mode, a "rinse" mode, and a "clean-out" mode. FIG. 2A shows the selector handle 49 in the soap mode of operation. FIG. 2B shows the selector handle 49 in the off-trickle mode of operation. FIG. 2C shows the selector handle 49 in the rinse mode of operation. FIG. 2D shows the selector handle 49 in the clean-out mode of operation.

In the soap mode of operation the dispenser adds soap into the water stream allowing it to be showered, already lathered or "sudsed", onto the user. Since the user is applying soap and does not want to have it immediately washed off, the water flow in this position is reduced. This has the additional benefit of saving water and soap in comparison with the usual practice of running the water at a high rate even when soap is being manually applied.

In the off-trickle mode of operation water flow is reduced to a trickle. This allows the user to wash with the water flow stopped, again saving both water and soap, but immediately restoring water flow at the precisely set volume and temperature setting when the user wishes to do so.

In the rinse mode of operation, water is delivered unimpeded to the shower head 6. Water flow volume is returned to normal.

The clean-out mode of operation allows the user to use the water flow to flush out small debris that may have entered the dispenser body 13 in the soap mode and that could potentially reduce the flow of water and the operation of the dispenser.

FIGS. 3A, 3B, 3C, and 3D show sectional views looking at the right side of the dispenser body 13, with the plane of the section taken from top to bottom of the dispenser body 13 separating a right side and a left side of the dispenser body. The water stream enters the dispenser body 13 at the water supply inlet 7, flows through an dispenser body inlet passage 16 to a main valve cavity 14 in which is located a main valve element 61, continues to flow through the main valve element 61, exiting the main valve cavity 14 into an dispenser body outlet passage 17, and then exits the dispenser body at the water supply outlet 8.

The main valve cavity 14 and main valve element 61 cooperate to control the flow of water, i.e., whether it is "ON" or "OFF", and the mode of operation of the dispenser. The various modes of operation of the dispenser are selected by rotation of the main valve element 61 to precise positions with respect to passageways in the dispenser body 13. The main valve element 61 has four positions corresponding to the four modes of operation of the dispenser.

Figures 3A, 3B, 3C, 3D:
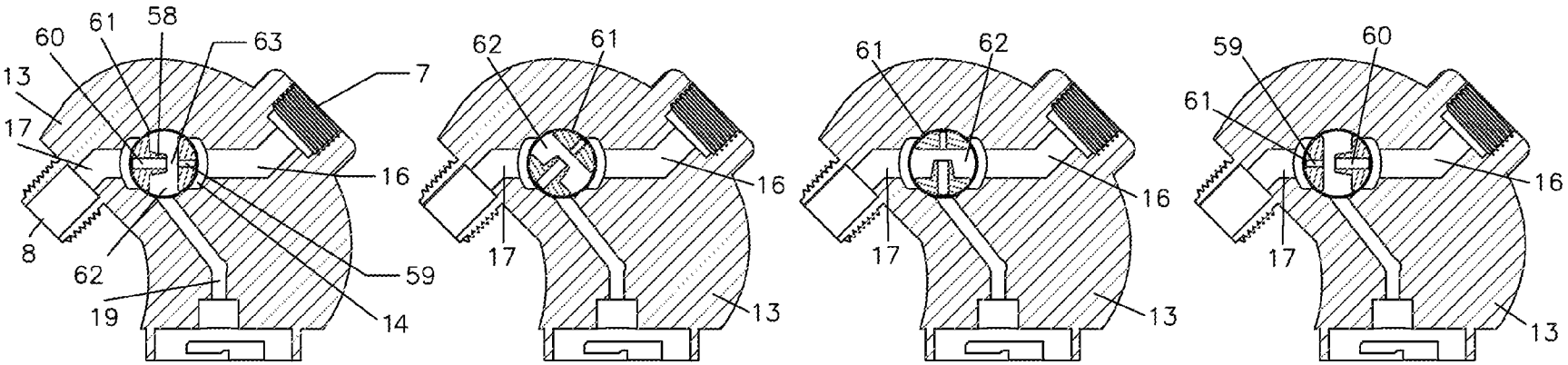
FIG. 3A shows a sectional view from the right side of an embodiment of the shower soap dispenser body with the main valve element in the soap position.
FIG. 3B shows a sectional view from the right side of an embodiment of the shower soap dispenser body with the main valve element in the off-trickle position.
FIG. 3C shows a sectional view from the right side of an embodiment of the shower soap dispenser body with the main valve element in the rinse position.
FIG. 3D shows a sectional view from the right side of an embodiment of the shower soap dispenser body with the main valve element in the clean-out position.

FIG. 3A shows an embodiment of the invention where the orientation of the main valve element 61 in the dispenser body 13 for the soap mode of operation. In this mode of operation, water flows through the main valve element 61 and mixes with liquid soap and air drawn into the water stream by siphon from the soap reservoir 10 through a soap supply passage 19. This is accomplished in the main valve element 61 by interactions between a metering passage and a straight-through passage 62. The metering passage comprises an inlet section 59, a mixing intersection 63 and an outlet section 60. The straight-through passage comprises an inlet section and an outlet section. The two passages are oriented perpendicular to each other and communicate at the mixing intersection 63. The metering passage outlet section 60 extends into the straight-through passage 62 in the shape of a truncated cone 58. The base of the truncated cone 58 is located at the outer diameter of the straight-through passage 62, and the top of the truncated cone 58 is located approximately at the center axis of the straight-through passage 62 and communicates with the metering passage mixing intersection 63.

An important function of the main valve element 61 is the provision of a venturi tube for the formation of a siphon. The metering passage inlet section 59 has a cross-sectional area that is less than the dispenser body inlet passage 16 and the metering passage outlet section 60. As water flows into the metering passage inlet section the volume is restricted and the water flow is concentrated. When the water flow reaches the metering passage mixing intersection 63, the passage cross-sectional area increases, creating a venture effect and resulting vacuum at the mixing intersection 63. The combination of the restricted diameter of the metering passage inlet section 59, the mixing intersection 63, and the proximity of the metering passage outlet section 60 to the metering passage inlet section 59 produce a venturi tube which can siphon liquid soap, or a mixture of liquid soap and air through straight through passage 62.

Figure 5:
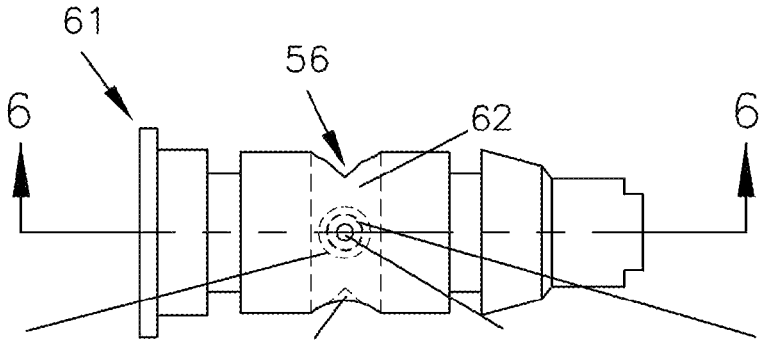
FIG. 5 shows a side view of the main valve element from the metering passage inlet section side in an embodiment of the shower soap dispenser.
Figure 6:
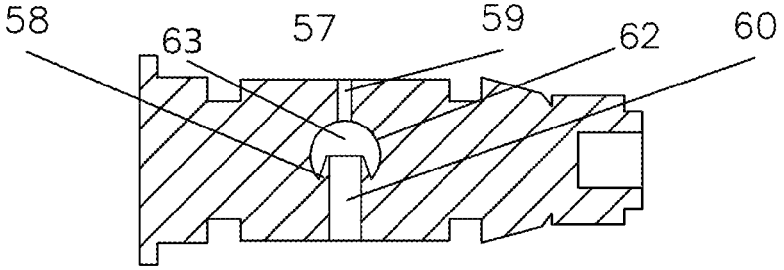
FIG. 6 shows a section view of FIG. 5 along the line 6-6.
Figure 7:
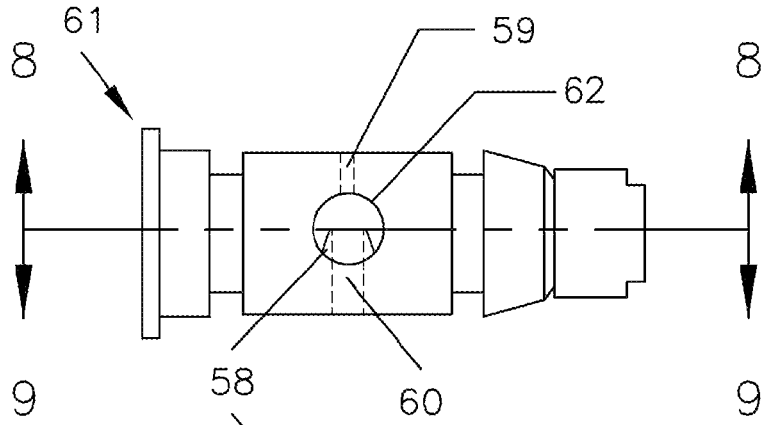
FIG. 7 shows a side view of the main valve from the straight-through passage inlet side in an embodiment of the shower soap dispenser.
Figure 8:
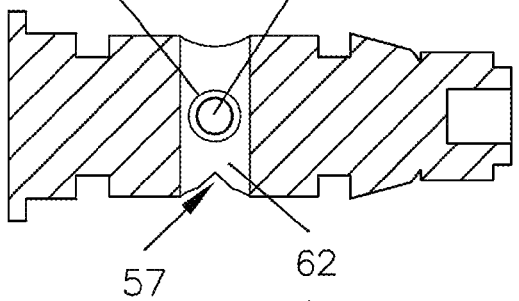
FIG. 8 shows a section view of the main valve of FIG. 7 along the line 9-9.
Figure 9:
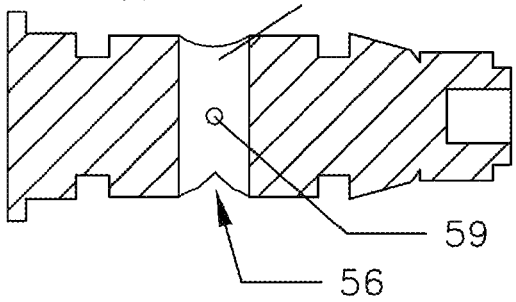
FIG. 9 shows a section view of the main valve of FIG. 7 along the line 8-8.

FIG. 6 shows section 6 of FIG. 5 in an embodiment of the invention and demonstrates the relationship of the metering passage inlet section 59, the mixing intersection 63 and the metering passage outlet section 60. The straight-through passage 62 communicates with the soap supply passage 19. The metering passage outlet section 60 extends into the straight through passage 62 to reduce the distance across the mixing intersection 63 between the metering passage inlet section 59 and outlet section 60. The protrusion of the metering passage outlet section 60 into the straight-through passage 62 is in the shape of a truncated cone 58, with the base of the cone at the wall of the straight-through passage 62 and the top of the cone at the mixing intersection 63. FIGS. 6 and 7 show the truncated cone 58 in an embodiment of the invention as it extends the metering passage outlet section 60 into the straight-through passage 62. FIG. 8 shows a section view of the orientation of the metering passage outlet section 60 in an embodiment of the invention as it communicates with the straight-through passage 62. FIG. 9 shows a sectional view of the orientation of metering passage inlet section 59 in an embodiment of the invention as it communicates with straight-through passage 62.

Figure 4A:
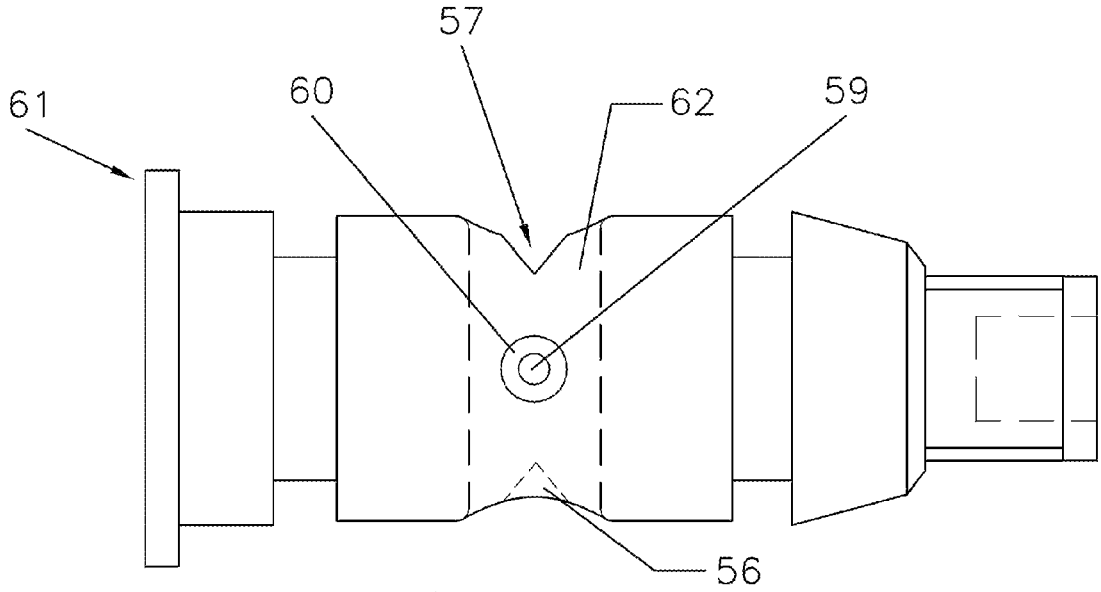
FIG. 4A shows a side view of the main valve element from the metering passage outlet section side in an embodiment of the shower soap dispenser.
Figure 4B:
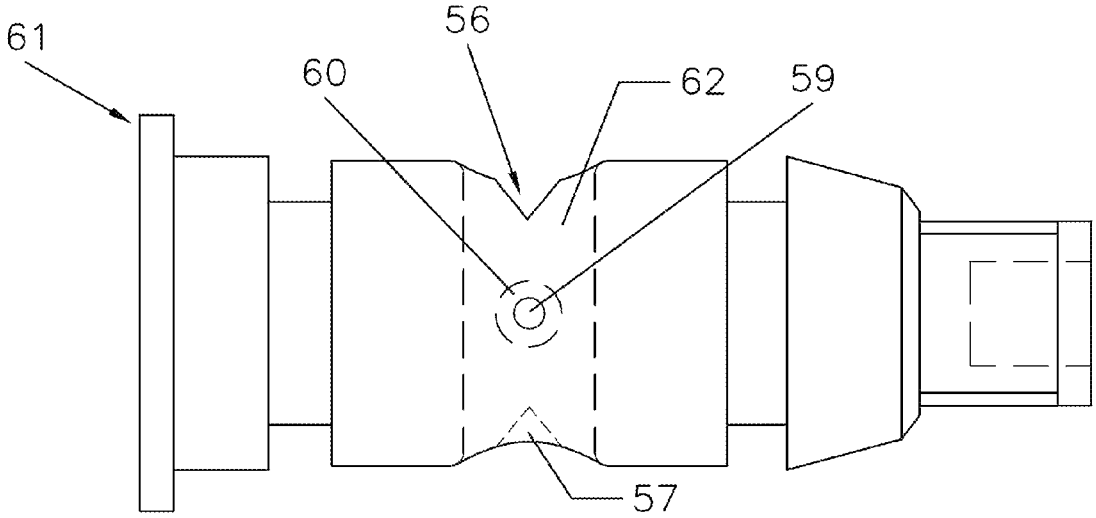
FIG. 4B shows a side view of the opposing side of the main valve element as shown in FIG. 4A from the metering passage outlet section side in an embodiment of the shower soap dispenser.

FIG. 3B shows the orientation of the main valve element 61 in the dispenser body 13 for the off-trickle mode of operation in an embodiment of the invention. In this mode of operation the flow of water through the main valve element 61 is reduced to a trickle. FIGS. 4A and 4B show a straight-through passage inlet side notch 56 and a straight-through passage outlet side notch 57 in an embodiment of the invention that are located at the inlet and outlet ends respectively of the straight-through passage 62. These notches communicate with dispenser body inlet passage 16 and outlet passage 17 allowing a very reduced flow of water through the dispenser body 13.

FIG. 3C shows the orientation of the main valve element 61 in the dispenser body 13 in an embodiment of the invention for the rinse mode of operation. In this mode of operation the straight-through passage 62 is oriented so that the inlet end of the straight through passage 62 communicates with the dispenser body inlet passage 16 and the outlet end of the straight-through passage 62 communicates with the dispenser body outlet passage 17. FIGS. 7, 8, and 9 show the straight-through passage 62 in embodiments of the invention.

FIG. 3D shows the orientation of the main valve element 61 in the dispenser body 13 in an embodiment of the invention for the clean-out mode of operation. In this mode of operation, the main valve element 61 is oriented 180 degrees from its position in the soap mode of operation so that the metering passage inlet section 59 communicates with the dispenser body outlet passage 17 and the metering passage outlet section 60 communicates with the dispenser body inlet passage 16. The flow of water is in the reverse direction through the metering passage so that the flow of water can dislodge any debris that may have entered the metering passage inlet section 59 in the soap mode of operation.

Although particular embodiments have been described, it will be appreciated by those skilled in art that the present invention is not limited merely to those embodiments shown. Many variations and modifications can be made without departure from the spirit of the present invention. For example, the materials, the particular shapes, and the arrangement of the body and the shape and arrangements of the valves, as well as their particular locations, can be changed from those which are specifically illustrated. These and other variations are specifically contemplated. Accordingly, variation of the preferred form and the particulars as described for the present invention may be undertaken without departure from the scope of the invention which is defined only by the claims which follow.

What is claimed is:

1. A soap dispenser for mixing a liquid soap from a soap reservoir, and air, into a flowing water stream from a pressurized water source, and for delivering water having entrained soap and air to an outlet, for ultimate delivery to the user, comprising:

a body, having an inlet (7), an outlet (8), and a main valve cavity (14) having an essentially circular cross section, and having:

an inlet passage (16) communicating between the inlet (7) and the main valve cavity (14), an outlet passage (17) communicating between the main valve cavity (14) and the outlet (8), a soap supply valve cavity (20) having a soap supply valve seat (22), an air supply valve cavity (28), a soap supply passage (19) having a first section communicating between the main valve cavity (14) and the soap supply valve cavity (20) and having a second section communicating between the soap supply valve cavity (20) and the soap reservoir (10), and an air supply passage (34) communicating between the air supply valve cavity (28) and the soap supply passage (19);

a main valve element (61) having an essentially cylindrical form, and rotatably mounted within the main valve cavity (14), said main valve element having:

a metering passage (59, 63, 60), having an inlet section (59), and an outlet section (60), wherein the metering passage inlet section (59) has a cross-sectional area smaller than the cross-sectional area of the inlet passage (16), and wherein the metering passage outlet section (60) has a cross-sectional area larger than the cross-sectional area of the metering passage inlet section (59), said metering passage inlet section (59), and metering passage outlet section (60) extending approximately diametrically through the main valve element and being positioned so that when the main valve element is rotated to a soap position the metering passage inlet section (59) communicates with the body inlet passage (16) and the metering passage outlet section (60) communicates with the body outlet passage (17) and when the valve element is rotated to a cleaning position the metering passage inlet section (59) communicates with the body outlet passage (17) and the metering passage outlet section (60) communicates with the body inlet passage (16), and a straight-through passage (62) having an inlet and an outlet, said straight-through passage (62) extending through the main valve element (61) at approximately its diameter, and communicating with an intersection (63) of the metering passage inlet section (59) and the metering passage outlet section (60), said metering passage outlet section (60) extending into the straight-through passage (62) approximately one-half of the diameter of said straight-through passage (62) and having a shape of a truncated cone (58) with a base of the cone at the circumference of the straight-through passage (62) and a top of the cone opening at the intersection (63), and when said main valve element (61) is in the soap position, the straight-through passage (62) communicates with the soap supply passage (19), and when the main valve element (61) is rotated to a rinse position the straight-through passage (62) communicates with the body inlet passage (16) and the body outlet passage (17);

a soap supply valve element (21) adapted to match to the soap supply valve cavity (20) and adjustably closeable with respect to the soap supply valve seat (22), whereby a restriction provided by the soap supply valve element (21) in conjunction with the soap supply valve seat (22) may be adjustably set; and an air supply valve element (29) adapted to match and adjustably closeable with respect to the air supply valve cavity (28), whereby a restriction provided by the air supply valve element (29) in conjunction with the air supply valve cavity (28) may be adjustably set.

2. An improved shower dispenser for liquid soaps comprising an improved main valve element having an essentially cylindrical form, and rotatably mounted within a main valve cavity of a dispenser body, said main valve element having:

a straight-through passage and a metering passage;

said straight-through passage extending approximately diametrically through the main valve element and having an inlet side and an outlet side;

said metering passage having an inlet section, a mixing intersection and an outlet section, extending approximately diametrically through the main valve element and approximately perpendicular to the straight-through passage and communicating with the straight-through passage at the mixing intersection at approximately a center axis of the main valve element;

said inlet section extending diametrically from an outer edge of the main valve element to the straight-through passage at the mixing intersection and having a cross-sectional area smaller than both the cross-sectional area of a dispenser body inlet passage and the cross-sectional area of the outlet section of said metering passage;

said outlet section extending diametrically from the outer edge of the main valve element diametrically opposed to the inlet section, into the straight-through passage approximately one-half of the straight-through passage diameter to the mixing intersection, an extension of said outlet section being in a shape of a truncated cone.

3. A shower dispenser according to claim 2 wherein the main valve element is rotated to a rinse position wherein said straight-through passage inlet side communicates with the dispenser body inlet passage and the straight-through passage outlet side communicates with a dispenser body outlet passage.

4. A shower dispenser according to claim 2 wherein the main valve element is rotated to a soap position wherein said metering passage inlet section communicates with the dispenser body inlet passage and the metering passage outlet section communicates with a dispenser body outlet passage and said straight-through passage inlet side communicates with a soap supply passage.

5. A shower dispenser according to claim 2 wherein the main valve element is rotated to a clean-out position wherein said metering passage is oriented so that the metering passage outlet section communicates with a dispenser body inlet passage and the metering passage inlet section communicates with a dispenser body outlet passage.

6. A shower dispenser according to claim 2 wherein the straight-through passage inlet side has a straight-through passage inlet side notch and the straight-through passage outlet side has a straight-through passage outlet side notch.

7. A shower dispenser according to claim 6 wherein the main valve element is oriented for the off-trickle mode of operation wherein said straight-through passage inlet side communicates with the dispenser body inlet passage at the straight-through passage inlet side notch and the straight-through passage outlet side communicates with a dispenser body outlet passage at the straight-through passage outlet side notch.

8. A method of inducing soaps of varying density in a water flow for the purpose of producing a soap and water mixture suitable for showering comprising the steps of:

introducing a water flow under pressure to one side of a rotatable valve element located in a dispenser body;

passing the water flow through the rotatable valve element via an entry tube and an exit tube and an intermediate mixing chamber;

managing water velocities by selecting an entry tube diameter that is less than the exit tube diameter;

managing the mixing of the soap and air with the water flow by extending the exit tube into the mixing chamber in a shape of a truncated cone having its base at an outer edge of the mixing chamber and extending into the mixing chamber toward the entry tube;

introducing soap and air to the mixing chamber via a suction tube extending between the mixing chamber and an interior soap reservoir; and delivering the mixture via a spray head in fluid communication with the exit tube.

* * * * *